United States Patent [19]

Belmont et al.

[11] Patent Number: 4,880,316

[45] Date of Patent: Nov. 14, 1989

[54] MULTIPLE LAYER HAND-GRIP REINFORCEMENT FOR THERMOPLASTIC DRAW TAPE HANDLES FOR THERMOPLASTIC BAGS

[75] Inventors: Kirk E. Belmont, Fairport; Edward M. Bullard, East Rochester; Daniel J. DiBiasi, Pittsford; Edward W. Forman, Jr.; David E. McIntyre, both of Palmyra, all of N.Y.

[73] Assignee: Mobil Oil Corporation, New York, N.Y.

[21] Appl. No.: 201,798

[22] Filed: Jun. 3, 1988

[51] Int. Cl.[4] ..... B65D 33/02; B65D 33/10; B65D 33/28

[52] U.S. Cl. ..... 383/75

[58] Field of Search ..... 383/75, 17; 493/225, 493/226; 53/413

[56] References Cited

U.S. PATENT DOCUMENTS

| | | | |
|---|---|---|---|
| 2,458,173 | 1/1949 | Kardon | 383/17 |
| 2,635,510 | 4/1953 | Grant | 493/226 |
| 2,652,187 | 9/1953 | Steen et al. | 493/226 |
| 3,029,853 | 4/1962 | Piazzi . | |
| 3,409,209 | 11/1968 | Finke | 493/226 |
| 3,506,048 | 4/1970 | Jortikka | 383/75 |
| 3,738,568 | 6/1973 | Ruda . | |
| 4,165,832 | 8/1979 | Kuklies et al. . | |
| 4,558,463 | 12/1985 | Boyd . | |
| 4,597,750 | 7/1986 | Boyd . | |
| 4,617,008 | 10/1986 | Boyd et al. . | |
| 4,624,654 | 11/1986 | Boyd et al. . | |
| 4,628,536 | 12/1986 | Herrington . | |
| 4,762,430 | 8/1988 | Bullard | 383/75 |

FOREIGN PATENT DOCUMENTS 1125363 8/1968 United Kingdom .

*Primary Examiner*—Stephen P. Garbe
*Attorney, Agent, or Firm*—Alexander J. McKillop; Charles J. Speciale

[57] ABSTRACT

A multiple layer hand-grip reinforcement for thermoplastic draw tape handles for thermoplastic bags and method of making the same is disclosed. The hand-grip reinforcement is produced by slitting a thermoplastic tape longitudinally with an undulating pattern to divide the tape into a pair of draw tapes each having alternating wide and narrow sections. The wide section has a dimension at least twice as great as the intervening narrow section. The wide section is folded over along a longitudinal crease line to provide a multiple layer tape section intermediate two single layer tape sections. The folded tapes are inserted into each hem of a draw tape bag with the multiple layer tape section aligned with a central cut out opening intermediate the ends of the hem and the ends of each draw tape are secured to the ends of the respective hems so that when the multiple layer tape section is gripped and pulled through the cut out opening in the hems to draw closed the open top of the bag the multiple layer hand-grip reinforcement minimizes the discomfort caused by roping at the hand area while the bag is under load.

13 Claims, 1 Drawing Sheet

MULTIPLE LAYER HAND-GRIP REINFORCEMENT FOR THERMOPLASTIC DRAW TAPE HANDLES FOR THERMOPLASTIC BAGS

FIELD OF THE INVENTION

The present invention relates to thermoplastic draw tape handles inserted in hems of thermoplastic bags, and in particular, to a multiple layer hand-grip reinforcement for draw tape handles especially designed to minimize the discomfort caused by "roping" at the hand area while the bag is under load. The term "roping" refers to the tendency to form a round cross-section with a small diameter across the palm of the hand of the carrier in low gauge/high strength thermoplastic draw tapes while the bag is under load.

BACKGROUND OF THE INVENTION

Bags made of thin polyethylene material have been used in various sizes. Small bags are used in packaging of sandwiches and the like. Larger bags are used as shopping bags. Even larger bags ar used for containing trash.

A particularly advantageous closure for such a bag includes a draw tape made from the same polyethylene material as the bag. U.S. Pat. No. 3,029,853—Piazzi, British Patent No. 1,125,363 Jortikka, U.S. Pat. No. 3,738,568—Ruda, U.S. Pat. No. 4,558,463—Boyd and U.S. Pat. No. 4,624,654 Boyd et al are examples of draw tape bags. Such closures have been successfully employed in these bags. Draw tape closures for large bags, and the manufacture of these draw tape bags are described in the aforesaid related U.S. Pat. Nos. 4,558,463 and 4,624,654. Other related patents are U.S. Pat. No. 4,617,008—Boyd et al which describes a hem forming apparatus and U.S. Pat. No. 4,597,750—Boyd et al which describes apparatus for inserting a draw tape into the bag. Bags having intermittently oriented draw tapes are disclosed in related U.S. Pat. No. 4,628,536—Herrington. The disclosure of the foregoing related patents are incorporated herein by reference.

In the past, thermoplastic bag structures with integral handle elements formed as an integral part of the bag structure itself have been produced by a method which reduces stress concentration. Stress points around the bag mouth are distributed to areas which are less likely to rupture as a result of stress concentration. See U.S. Pat. No. 4,165,832—Kuklies et al. This patent discloses a thermoplastic bag structure with integral handle elements, i.e. the handles are actually an extension of the bag proper and stress relief notches are positioned at opposite ends of the mouth. This patent also discusses the effect of "roping" while the bag is under load. Another technique that has been employed in the past in connection with integral handles of thermoplastic bags is to place patches of additional thermoplastic material around the handle openings. These patches are heat sealed or spot welded to the handle portions.

Draw tape bags have a draw tape that is a separate structure from the bag proper. Draw tape bags of the type made according to the above mentioned Boyd et al patents normally have a 1" wide draw tape for the full width of the bag. When the tape is pulled hard to close the bag, it elongates over most of its length and the area where it is gripped by the hand, becomes narrow, or "ropes" and hurts the hand. It is possible to make a draw tape that is sufficiently strong at thin gauges, such as 1.5 mils., but this tape is unsatisfactory for use because of the "roping" effect. As a result, it has been customary to use a tape material that is thicker, thus more costly than that which is required for performance. For example, tape thicknesses that have been used are in the order of 3 to 4 mils., about twice what is actually required.

It is desirable to produce a thermoplastic bag handle of a smaller gauge, less costly material, while substantially preventing "roping" at the area of the handle held by the hand of the carrier. It is also desirable to minimize the discomfort caused by roping by providing a hand-grip at the central area of the handle.

The following related patent applications disclose draw tape configurations for draw tape bags especially designed to reduce stress concentrations or "roping" and/or to provide a hand-grip at the hand are while the draw tape bag is under load.

RELATED APPLICATIONS:

"Ribbed Draw Tape for Thermoplastic Bag", Edward M. Bullard, Ser. No. 71,296, filed July 9, 1987 now U.S. Pat. No. 4,762,430, describes a draw tape for a bag having transverse or angular ribs which reduce roping of the draw tape when lifting a loaded bag. "Variable-Width Draw Tape for Thermoplastic Bags", Daniel J. DiBiasi and Fox J. Herrington, Ser. No. 134,270 filed Dec. 14, 1987 describes a draw tape for a bag where the draw tape is made wider at the center area where it is gripped by hand for forcing any elongation to occur at some other point thereby preventing "roping" at the hand area. "Non-Roping Thermoplastic Draw Tape for Thermoplastic Bags", Daniel J. DiBiasi and David A. Bryniarski, Ser. No. 157,753 filed Feb. 19, 1988 describes a reinforced draw tape handle with a reinforcing patch. "Method and Apparatus for Making Non-Roping Thermoplastic Draw Tape for Thermoplastic Bags", David A. Bryniarski and E. Grosz, Ser. No. 157,751 filed Feb. 19, 1988 now U.S. Pat. No. 4,822,437 describes a method and apparatus to permit continuous application of a reinforcing patch to a draw tape at the center area where it is gripped by hand. "Hand-Grip for Thermoplastic Draw Tape Handles for Thermoplastic Bags", Kirk Belmont et al, Ser. No. 201,799 filed Jun. 3, 1988, now U.S. Pat. No. 4,813,792 describes a hand-grip for a draw tape bag and method of making the same. "Reinforced Handle for Thermoplastic Draw Tape Bags", Kirk Belmont et al., Ser. No. 201,723 filed Jun. 3, 1988, now U.S. Pat. No. 4,813,793 describes a padded hand grip for a draw tape bag and method of making the same. The disclosures of the foregoing applications are assigned to the same assignee as the present application and are incorporated herein by reference.

SUMMARY OF THE INVENTION

It is an object of the invention to provide a thermoplastic draw tape bag wherein the discomfort caused by "roping" at the central area of the handle of low gauge/high strength thermoplastic draw tapes held by the hand of the carrier is reduced by folding over the central area of the draw tape handle to provide a multiple layer hand-grip reinforcement in the handle. It is also an object of the invention to provide the multiple layer only at the hand-grip section of the tape handle to minimize the material used and thus decrease the cost of the tape. It is a further object of the invention to provide a method of making a multiple layer hand-grip reinforcement for a draw tape handle which is relatively easy to manufacture.

In accordance with on aspect of the invention there is provided a thermoplastic draw tape bag for carrying trash and the like having a multiple layer hand-grip reinforcement for the draw tape handle. The bag comprises two thermoplastic panels forming an open top, closed bottom bag, the panels being joined along the sides of the bag. A hem on each of the panels is folded over adjacent the top, the bottom and ends of each hem being sealed to the adjacent panel, each of the hems having a cut out opening intermediate the ends of the hems. A thermoplastic draw tape handle is disposed in each hem secured to the ends of the hem and each draw tape comprises a center section and two side sections. The side sections are secured to the ends of the hem and the center section is in alignment with the cut out opening and comprises a folded over multiple layer tape area. The multiple layer tape area has a length adequate to provide a hand-grip reinforcement for the tape so that when the center section is gripped and pulled through the cut out opening in the hems to draw closed the open top of the bag the multiple layer hand-grip reinforcement minimizes the discomfort caused by roping at the center section while the bag is under load.

In accordance with another aspect of the invention there is provided a method of making a hand-grip reinforcement in a low gauge/high strength thermoplastic draw tape for thermoplastic draw tape bags. The method comprises the steps of slitting a tape longitudinally with an undulating pattern to divide the tape into a pair of draw tapes each having alternating wide and narrow sections. The wide section has a dimension at least twice as great as the intervening narrow section. The wide section is folded over along a longitudinal crease line to provide a multiple layer tape section intermediate two single layer tape sections. One of the folded tapes is inserted into each hem of a draw tape bag with the multiple layer tape section aligned with a central cutout opening intermediate the ends of the hems. The ends of each draw tape are secured to the ends of the respective hems so that when the multiple layer tape section is gripped and pulled through the cut out opening in the hems to draw closed the open top of the bag, the multiple layer hand-grip reinforcement minimizes the discomfort caused by roping at the hand area while the bag is under load.

The foregoing and other objects, features and advantages of the invention will be more apparent from the following detailed description and appended claims.

DESCRIPTION OF THE PREFERRED EMBODIMENT

Figure 1:
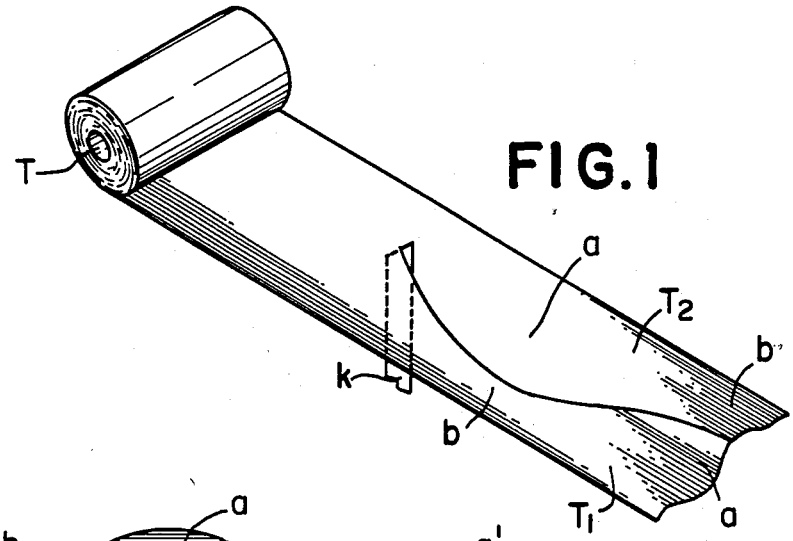
FIG. 1 shows a roll of thermoplastic draw tape having a width somewhat wider than what is required for two conventional tapes being slit in an undulating manner.
Figure 2:
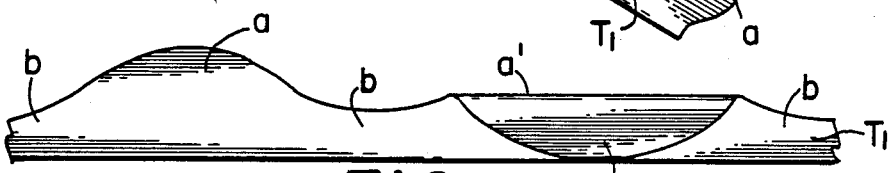
FIG. 2 is a view of one of the slit tapes folded over at the wider flap area along the crease line to provide a double thick tape area.
Figure 4:
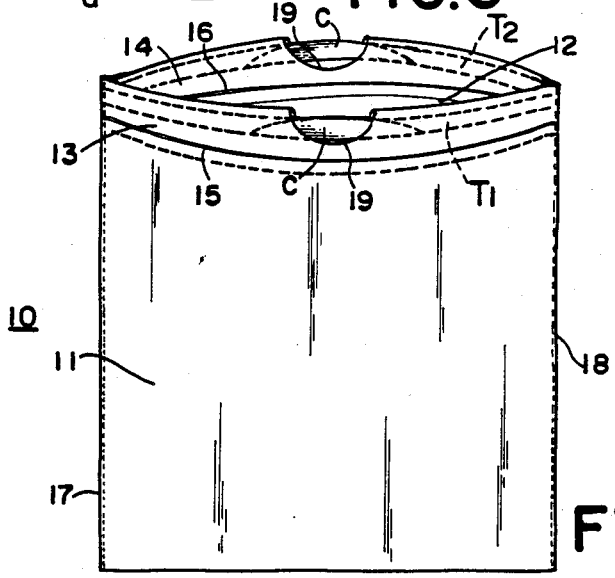
FIG. 4 is a perspective view of a thermoplastic draw tape bag embodying the draw tapes with a multiple layer hand-grip reinforcement area in accordance with the present invention.

The method of making a multiple layer hand-grip reinforcement for thermoplastic draw tape handles for thermoplastic bags is illustrated in FIGS. 1 and 2. A draw tape bag 10 embodying the present invention is illustrated in FIG. 4. As shown in FIG. 1 a roll of draw tape T having a width somewhat wider than what is required for two conventional draw tapes is slit longitudinally by a knife k into a pair of draw tapes $T_1$ and $T_2$ each having alternating wide and narrow sections a and b. As may be seen in FIGS. 1 and 2 the wide section a has a narrow section b disposed on each side thereof. The wide section a has a width twice as wide as the narrow section b so that when the wide section a is folded over along a longitudinal crease line a', FIG. 2, it will provide a double thick tape area c for a hand-grip reinforcement in the draw tape. The folded over layer at the wide section a may be fastened in place by gluing, heat sealing or other means if desired to hold it in place.

A draw tape bag 10 embodying the draw tapes of FIGS. 1 and 2 is illustrated in FIG. 4. The bag 10 includes two panels 11 and 12, formed from an extruded tube of polyethylene which is slit along the side to form an open top. Each panel 11 and 12 is folded over adjacent the top to form hems 13 and 14 respectively for receiving the draw tapes $T_1$ and $T_2$. Prior to inserting the draw tapes each of the hems 13 and 14 is provided with a central cut out opening 19 intermediate the ends of the hems. The draw tapes $T_1$ and $T_2$ preferably of thin gauge polyethylene film, such as 1.5 mils. are inserted into the respective hems, 13, 14 and the hems are heat sealed horizontally at 15 and 16. The side edges of the panels 11 and 12 are heat sealed at 17 and 18 along with the ends of the respective hems 13, 14 and the ends of the draw tapes $T_1$ and $T_2$. The panels 11 and 12 are cut from the tube in a perpendicular direction along with the draw tapes $T_1$ and $T_2$ to complete the draw tape bag 10. As may be seen in FIG. 4 the central cut out openings 19 intermediate the ends of the hem permit the draw tapes $T_1$ and $T_2$ to be grasped and thereafter pulled out through the opening 19. The hand-grip reinforcements c for each of the draw tapes $T_1$ and $T_2$ are aligned with the openings 19. When the bag 10 is loaded, the draw tapes $T_1$ and $T_2$ are grasped at the center section by the hand-grip reinforcements c,c and pulled through the cut out openings 19, thereby moving the open mouth of the bag to a closed condition. The multiple layer hand-grip reinforcement c minimizes the discomfort caused by roping at the center section while the bag is under load.

Figure 3:
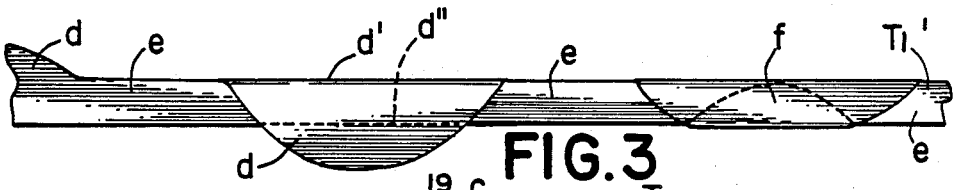
FIG. 3 shows another embodiment of a draw tape with multiple folding to provide more than a double thickness at the hand-grip reinforcement area.

Referring to FIG. 3 there is illustrated another embodiment of the present invention wherein the draw tape $T_1'$ is provided with more than a double thickness at the hand-grip reinforcement area. In FIG. 3 the wide section d of the tape has been illustrated as having a width corresponding to three times the width of the narrow section e so that when the wide section d is folded over twice along the longitudinal crease lines d' and d'' it will provide a hand-grip reinforcement area f having a triple thickness of the draw tape material. The folded over layers of the wide section d may be fastened in place by gluing, heat sealing or other means if desired to hold them in place. The draw tape $T_1'$ of FIG. 3 may then be inserted into the thermoplastic draw tape bag shown in FIG. 4 in the same manner as previously described.

What is claimed is:

1. A thermoplastic draw tape bag for carrying trash and the like having a multiple layer hand-grip reinforcement for the draw tape handle comprising:

two thermoplastic panels forming an open top, closed bottom bag, the panels being joined along the sides of the bag;

a hem on each of said panels folded over adjacent the top, the bottom and ends of each hem being sealed to the adjacent panel, each of the hems having a cut out opening intermediate the ends of the hems; and a thermoplastic draw tape handle disposed in each hem secured to the ends of said hem and each draw tape comprising a center section and two side sections, the side sections each comprising a single layer of tape being secured to the ends of the hem and the center section being in alignment with said cut out opening and comprising a folded over multiple layer tape area, the multiple layer tape area having a length adequate to provide a hand-grip reinforcement for the tape so that when the center section is gripped and pulled through the cut out opening in the hems to draw closed the open top of the bag, the multiple layer hand-grip reinforcement minimizes the discomfort caused by roping at the center section while the bag is under load.

2. A thermoplastic draw tape bag according to claim 1 wherein said multiple layer tape area has a double tape thickness.

3. A thermoplastic draw tape bag according to claim 1 wherein said multiple layer tape area has a triple tape thickness.

4. A thermoplastic draw tape bag according to claim 1 wherein the layers of said folded over multiple layer tape area are sealed together.

5. A method of making a hand-grip reinforcement in a low gauge/high strength thermoplastic draw tape for insertion in the hems of thermoplastic draw tape bags, each hem having a cut out opening intermediate the ends thereof comprising the steps of:

slitting a thermoplastic tape longitudinally with an undulating pattern to divide the tape into a pair of draw tapes each having alternating wide and narrow sections, the wide section having a dimension at least twice as great as the intervening narrow section;

folding over the wide section along a longitudinal crease line to provide a multiple layer tape section intermediate two single layer tape sections;

inserting one of the folded tapes into each hem of a draw tape bag with the multiple layer tape section aligned with a central cut out opening intermediate the ends of the hem; and securing the ends of each draw tape to the ends of the respective hems so that when the multiple layer tape section is gripped and pulled through the cut out opening in the hems to draw closed the open top of the bag, the multiple layer hand-grip reinforcement minimizes the discomfort caused by roping at the hand area while the bag is under load.

6. A method of making a hand-grip reinforcement according to claim 5 wherein the multiple layer tape section has a double tape thickness.

7. A method of making a hand-grip reinforcement according to claim 5 wherein the wide section of the tape has a dimension at least three times as great as the intervening narrow section and the multiple layer tape section comprises a triple thickness of the draw tape.

8. A method of making a hand-grip reinforcement according to claim 5 including the step of sealing together the layers of tape in the multiple layer tape section.

9. A thermoplastic draw tape bag having a hand-grip reinforcement produced according to the method of claim 5.

10. A method of making a hand-grip reinforcement in a low gauge/high strength thermoplastic draw tape for thermoplastic draw tape bags comprising the steps of:

slitting a thermoplastic tape longitudinally with an undulating pattern to divide the tape into a pair of draw tapes each having alternating wide and narrow section, the wide section having a dimension at least twice as great as the intervening narrow section; and folding over the wide section along a longitudinal crease line to provide a multiple layer tape section intermediate two single layer tape sections.

11. A method of making a hand-grip reinforcement according to claim 10 wherein the multiple layer tape section has a double tape thickness.

12. A method of making a hand-grip reinforcement according to claim 10 wherein the wide section of the tape has a dimension at least three times as great as the intervening narrow section and the multiple layer tape section comprises a triple thickness of the draw tape.

13. A method of making a hand-grip reinforcement according to claim 10 including the step of sealing together the layers of tape in the multiple layer tape section.

* * * * *